US005355722A

United States Patent [19]

Socier

[11] Patent Number: 5,355,722

[45] Date of Patent: Oct. 18, 1994

[54] CONDUIT FLARING APPARATUS

[76] Inventor: Jerry C. Socier, 655 N. SE. Boutell, Bay City, Mich. 48708

[21] Appl. No.: 59,107

[22] Filed: May 11, 1993

[51] Int. Cl.[5] ..... B21D 19/04

[52] U.S. Cl. ..... 72/82; 72/84

[58] Field of Search ..... 72/81, 82, 84, 86, 91; 267/24, 26

[56] References Cited

U.S. PATENT DOCUMENTS

| | | | |
|---|---|---|---|
| 1,276,397 | 8/1918 | Naylor | 72/82 |
| 2,005,215 | 6/1935 | Batie | 72/84 |
| 3,260,515 | 7/1966 | Albers | 267/124 |
| 3,762,204 | 10/1973 | Socier | 72/316 |

*Primary Examiner*—Lowell A. Larson

*Attorney, Agent, or Firm*—John J. Swartz

[57] ABSTRACT

Tube flaring apparatus for forming a radially outwardly extending flange at one end of a hollow malleable cylindrical conduit including a rotating spindle journaled on a stationary housing and mounting a chuck at one end thereof. The chuck cantileverly supports an axially extending conduit to be flared. A flaring tool is mounted for movement between an axially outer radially inner position removed from the conduit and an axially inner, radially outer position bearing against the inner surface of the outer end of the conduit to radially and axially displace the end to form a flange. The flaring tool is coupled to a piston rod axially driven by a fluid operated cylinder which is mounted in fixed relation relative to the chuck at the axially opposite end of the rotating spindle.

18 Claims, 4 Drawing Sheets

CONDUIT FLARING APPARATUS

BACKGROUND OF THE INVENTION

1. Field of the Invention

This invention relates to apparatus for forming a flange on an end of a hollow malleable cylindrical conduit and more particularly to new and improved apparatus for axially moving a flange forming roll to radially flare a malleable conduit.

2. Description of the Prior Art and Objects

Conduit flaring apparatus has been provided heretofore, as illustrated in U.S. Pat. No. 3,762,204 granted to Jerry C. Socier on Oct. 2, 1973. The apparatus disclosed herein is an improvement over the apparatus disclosed in the aforementioned patent. The prior art conduit flaring construction incorporates a rotating head whereas the apparatus constructed according to the present invention includes a stationary head journaling a rotatable spindle therein. In the prior patented structure, a hydraulically operated cylinder and associated piston are provided for axially moving a flaring tool, however, the cylinder is axially moveable and axially floats relative to a workpiece holding chuck. With the apparatus constructure according to the present invention, a fluid operated cylinder is provided, however, it is pneumatically operated rather than hydraulically operated and is axially stationary relative to the workpiece holding chuck.

The prior art patented structure included a spring, disposed between the hydraulically operated cylinder and the rotating head, which was compressed when the flaring operation took place. The use of such a spring, although operable and functional, tends to continually axially outwardly urge the hydraulically operated cylinder to an axially spaced position, axially removed away from the workpiece and thus tends to exert force on the flange forming roll. Such forces can sometimes cause the flaring tool to dent or form a mark on the part being formed. The apparatus constructed according to the present invention eliminates the aforementioned spring and includes a pneumatically operated cylinder which is axially stationary relative to the workpiece holding chuck.

The prior art patented structure would allow the forming or flaring roll to "float" and axially move throughout the forming operation. It is important that the flange formed on the part be disposed at an angle 90° relative to the balance of the cylinder. If the forming roll is allowed to float throughout the forming cycle, the elbow or junction of the flange and cylinder will not form a sharp 90° angle but will be curved or rounded. Accordingly, it is an object of the present invention to provide a new and novel apparatus and method for forming a flange on a part which forms a sharp 90° bend with the cylinder.

Another object of the present invention is to provide forming apparatus of the type described which will positively hold the flaring roll axially stationary during the final stages of the flaring operation.

In the prior art patented construction, the axial length of the parts vary depending on sharpness and the length of the elbow between the flange and the cylinder from which the flange is formed. The axial length is sometimes critical. Accordingly, it is an object of the present invention to provide new and novel flange forming apparatus of the type described which will manufacture flanged parts with more precise axial tolerances.

It is another object of the present invention to provide flaring apparatus of the type described including a stationary head journaling a rotating spindle for driving a workpiece mounting chuck.

It is a further object of the present invention to provide tube flaring apparatus of the type described including a pneumatically operated cylinder for axially displacing a flange forming roll.

It is a still further object of the present invention to provide tube flaring apparatus of the type described including a fluid pressure operated cylinder which is axially stationary relative to the workpiece holding chuck at one end of a chuck rotating spindle and a fluid pressure operated piston received by the cylinder and coupled via a piston rod to a workpiece flaring tool at the axially opposite end of the spindle.

Yet another object of the present invention is to provide tube flaring apparatus of the type described which eliminates the necessity of springs that are compressed when a fluid pressure operated cylinder axially moves a conduit flaring roll during the operation of a flaring operation.

It is another object of the present invention to provide tube flaring apparatus of the type described which includes a stationary, pneumatically operated cylinder at one axial end of a tube to be flared, including a piston which mounts, at the axially opposite end of the tube, a rotatable, radially translatable, flaring roll which, during the initial part of the forming cycle, axially translates, in a direction away from the tube to be flared, and thereafter, is axially stationary while the flaring roll swings to an angularly related, flaring position.

Other objects and advantages of the present invention will become apparent to those of ordinary skill in the art as the description thereof proceeds.

SUMMARY OF THE INVENTION

Tube flaring apparatus for forming a radially outwardly extending flange on an end of a hollow, malleable cylindrical conduit comprising: a stationary support member, a hollow, rotary drive spindle journaled on the stationary support member for rotation about an axis; workpiece holding mechanism, coupled to one end of the drive spindle for rotation therewith, cantileverly mounting a hollow, malleable conduit workpiece for rotation about the axis; axially and radially translatable flare forming roll mechanism, adjacent one end of the drive spindle, moveable between an axially outer, radially inner position removed from the conduit, and an axially inner, radially outer, conduit flaring position, bearing against a radially inner portion of one end of the malleable conduit to axially and radially displace one end of said conduit and form the flange.

DESCRIPTION OF THE DRAWINGS

The invention may be more readily understood by referring to the accompanying drawings, in which.

DESCRIPTION OF THE PREFERRED EMBODIMENT

Figure 1:
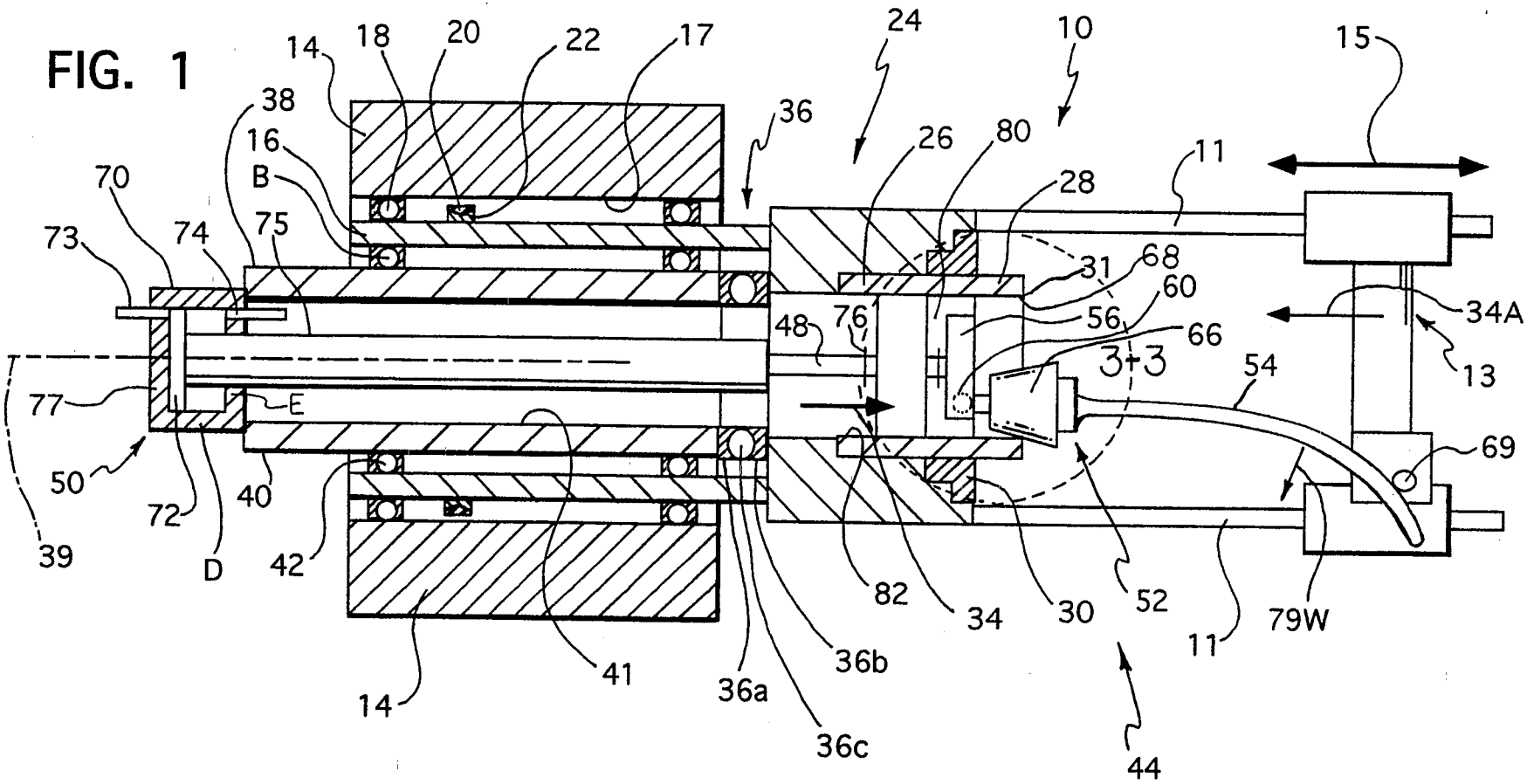
FIG. 1 is a sectional plan view of apparatus constructed according to the present invention.
Figure 2:
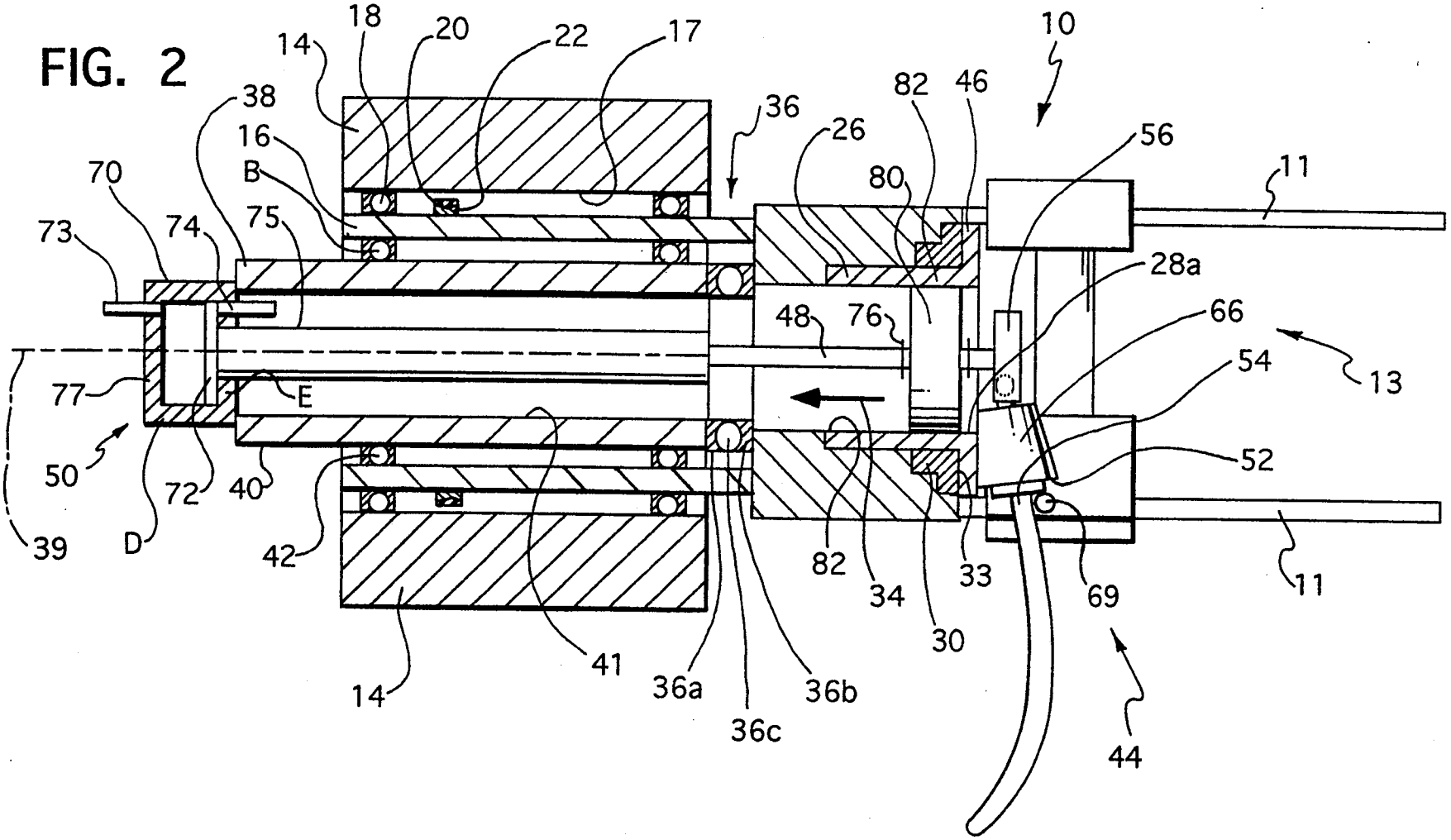
FIG. 2 is a similar sectional plan view of the apparatus constructed according to the present invention, with parts thereof illustrated in adjusted positions.
Figure 3:
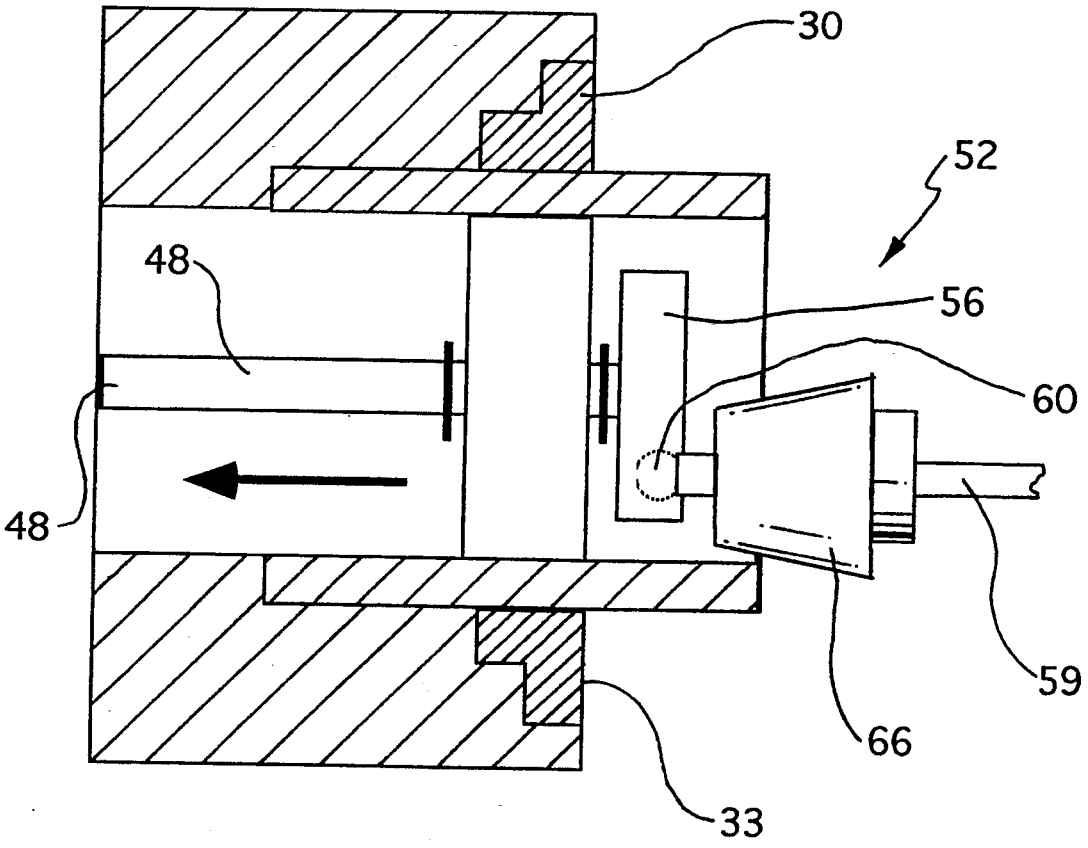
FIG. 3 is an enlarged sectional plan view of the portion encircled in chain line 3—3 of FIG. 1.

Lathe apparatus constructed according to the present invention, generally designated 10, includes a pair of guide rods, generally designated 11, mounting an axially translatable tool actuating carriage, generally designated 13, for to-and-for translational axial movement in the direction of the arrows 15, between the inoperative position illustrated in FIG. 1 and the tool flaring position illustrated in FIG. 2.

The apparatus 10 includes a frame supported, stationary head, generally designated 14, having a bore 17 therethrough journaling a hollow spindle 16 via bearings 18. The spindle 16 is rotated via a motor driven belt 20 coupled to a motor (not shown) trained around a pulley 22 fixed to the outer surface of the spindle 16.

Affixed to the spindle 16 is a universal workpiece holding chuck, generally designated 24, of conventional construction, for clamping an axially inner end 26 of a workpiece, generally designated 28.

The workpiece 28, which is cantileverly supported by the chuck 24, comprises a cylindrical, malleable conduit, such as a copper tube.

Mounted on the axially outer end of the chuck 24 is a master pattern, generally designated 30, having the desired configuration of a flange to be flared on the workpiece 28. The chuck 24 is precluded from axial movement in the direction of the arrow 34 toward the stationary head 14 via a thrust bearing, generally designated 36, having axially opposed races **36*a* and 36*b* on axially opposite sides of a plurality of ball bearings 36*c***.

Bearing against the inner race **36*a* is a frame supported, stationary, cylindrical stop, generally designated 38. The spindle 16 is journaled for rotation on the outer cylindrical surface 40 of cylindrical stop 38 via bearings 42**.

Flange forming, tube flaring apparatus, generally designated 44, is provided for forming a flange 46 on the axially outer, free terminal end 31 of the workpiece conduit 28.

The tube flaring apparatus 44 includes a support rod, generally designated 48, which is axially translatable along the axis 39 at one axial end of spindle 16 via a pneumatically operated apparatus, generally designated 50, at the axially opposite end of the spindle 16.

The flaring apparatus 44 includes a frusto-conical forming roll, generally designated 52, rotatably mounted on a guide rod, generally designated 54, which is journaled on the axial outer terminal yoke 56 on the rod 48, via a pivot pin 60. The forming roll 52 is concentric or coaxial with the axis 62 of the guide rod 54. This structure is generally illustrated in the aforementioned U.S. Pat. No. 3,762,204 which is incorporated herein by reference.

The axially translatable carriage apparatus, generally designated 13, is provided for radially swinging the forming roll 52 from the radially inner position, (FIG. 1) removed from the workpiece 28 to a radially outer position, illustrated in FIG. 2, wherein the outer surface 66 of forming roll 52 engages the inner surface 68 of the workpiece end 31 to radially outwardly displace the end 31 of conduit 28.

The pneumatically operated apparatus 50 axially translates the flare forming mechanism 44 from the axially inner forming position, illustrated in FIG. 2, to the axially outer forming position illustrated in FIG. 1. The apparatus 50 includes a pneumatically operated cylinder 70 having a piston 72 therein which is axially translatable between the position illustrated in FIG. 2 and the position illustrated in FIG. 1 via pressurized air admitted through port 74. Port 73 at the opposite end of the cylinder is open to atmosphere. The piston 72 is coupled to a reduced diameter piston rod 75 which is sealed to the end wall 76 via suitable sealing mechanism such as O-rings and coupled to the rod 48 in coaxial alignment therewith.

The carriage 13 includes a cam rod 69 for guiding against the rod 54 to swing the rod 54 radially outwardly as the carriage 13 moves upstream in the direction of the arrow 34A.

Figure 4:
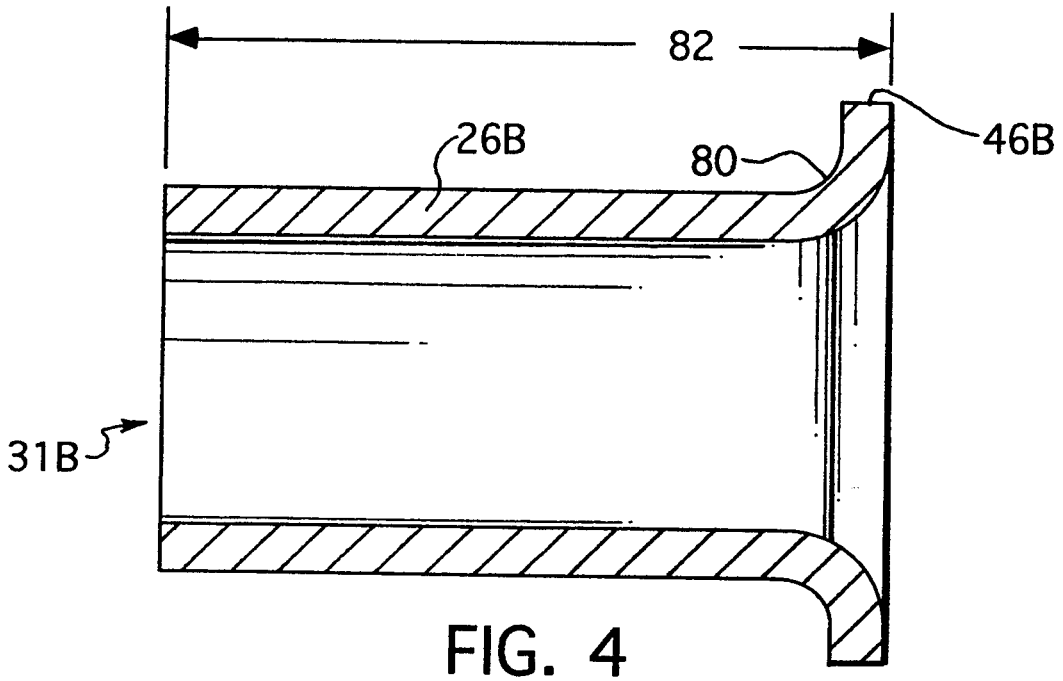
FIG. 4 (PRIOR ART)
FIG. 4 is an enlarged sectional side view of a prior art flange part formed in prior apparatus.
Figure 5:
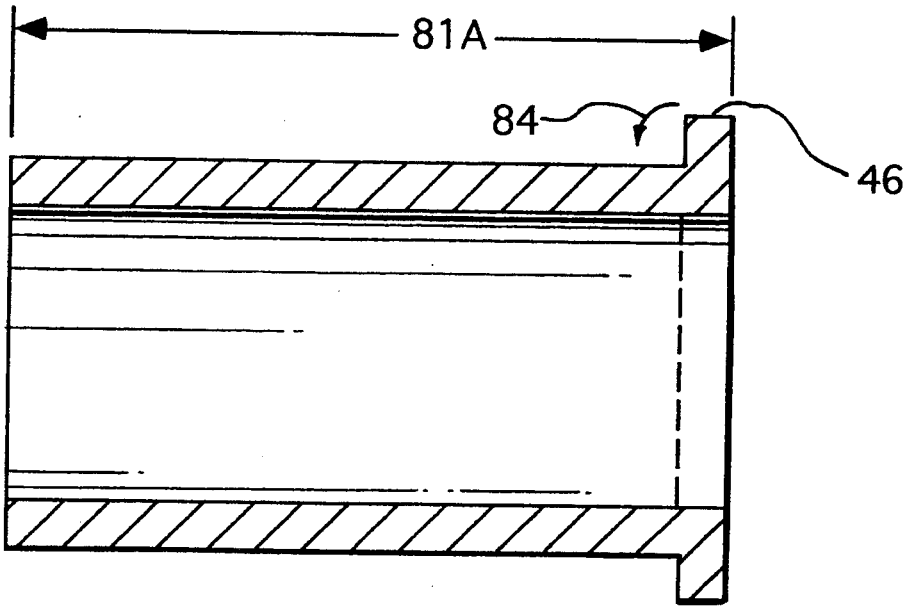
FIG. 5 is an enlarged sectional side view illustrating a part formed according to apparatus constructed according to the present invention.

In the prior art article, illustrated in FIG. 4, generally designated 31B, the junction 80 between the flange 46B and balance of the cylinder 26B is rounded, not sharp, and does not form a 90 angle. The amount of bend and turn varies between various parts. Accordingly, the overall lengths 82 of different articles 31B vary depending upon the thickness of the cylinder 26B and the amount of float in the system.

With the apparatus constructed according to the present invention, the flange 46 is at a 90° angle 84 and thus the overall length 81A is relatively consistent and exact.

As the forming roll and leverage arm or rod 54 move clockwisely, in the direction of the arrow W, the pivot pin 60, rod end 56, and rod 48 will be axially forced in the direction of the arrow 34. The force will be transmitted to piston 72 which will force air outwardly through orifice 74. A regulator (not shown) allows the pressurized air to be gradually bled off as the pressure on piston builds in the direction of the arrow 34.

The yoke 56 and rod 48 will tend to move to the right as the forming roll 52 bears against the terminal tube end 31. Once the air between the piston 72 and end wall E is all bled off the cylinder 70 through port 74, the piston 72 will "bottom out" against the end wall E, the pivot pin 66 will thus become axially stationary and the roll 52 will continue to swing downwardly in the direction of the arrow W until it reaches the position illustrated in FIG. 2. As it moves from the position illustrated in FIG. 1 to the position illustrated in FIG. 2, the forming roll 52 will progressively axially, as well as radially, displace the flange portion 31, until the flange 46 is pressed against the outer face 33 of the master 30 as illustrated in FIG. 2.

The cylinder 70 is fixed to the cylindrical stop 38 to preclude relative movement of the cylinder relative to the head 24.

Mounted on the rod 48 via snap rings 76 is a thrust bearing roller 80 which bears against and rotates within a radially and axially inner portion 82 of the workpiece 31.

THE OPERATION

It will be assumed that the parts are initially in the positions illustrated in FIG. 1 wherein a workpiece 28 is clamped to, and cantileverly supported by, a workpiece holding chuck 24 which is being rotated about axis 39 via the spindle 16.

The carriage 13 will be axially translated, in the direction of the arrow 34A, so that the cam rod 69 bears against the rod 54 to radially outwardly force the forming roll 52 into engagement with the inner surface 68 of the terminal conduit end 31. As the roll 52 engages the flange end 31, the piston rod 72 is axially, forced in the direction of the arrow 34, against the biasing force of the air within the cylinder 70. As the air is bled off at 74, the piston 72 will be allowed to move in a direction towards the right until it proceeds to the position illustrated in FIG. 2.

As the forming tool 64 radially outwardly flares the tube end 31 to form the flange 46, axial force exerted by the flaring roller 52 on the conduit 31 will be axially transmitted to the head 24, thence to thrust bearing 36 and to stop 32. The cylinder 70 is thus precluded from axially moving relative to the head 24. The piston rod 75 and support rod 48, pass through the bore 41 of cylinder stop 38 to the axially opposite end of spindle 16. When the piston 72 bottoms out against the cylinder end wall E, the rod end or yoke 56 will cease moving in a direction, represented by the arrow 34, towards the right and the roller 52 will then quickly rotate to its final position illustrated in FIG. 2 to form the flange 46.

After the flange is formed, the carriage 13 is returned to the position illustrated in FIG. 1. The finished work piece 28 is axially removed from the chuck 24 and passed over the roller 66 and rod 54. Another unfinished cylindrical roll work piece 28 is passed over the rod 54 and roller 66 to be mounted on chuck 24.

Air is admitted to port 74 to return the piston 72 and force the piston 72 to bottom out against the end wall 77, in the position illustrated in FIG. 1, so that the operation can be repeated. The cylinder 72 will bottom out against the wall 77 to accurately and repeatedly position the start position of rod 48, rod end 56 and roller 66.

The fixing of the cylinder 70 relative to the head 14 and the elimination of springs provided in the aforementioned patented structure eliminates the otherwise built-in variable force which the forming roll 52 exerts on the flange 31. Accordingly, the flaring force can now be more accurately controlled and maintained relatively constant throughout the flaring operation.

As opposed to the use of the single forming roll 52, a double roll, such as that illustrated in the aforementioned U.S. Pat. No. 3,762,204 could likewisely be utilized.

The engagement of the piston 72 with the end wall E to positively stop movement thereof after allowing limited axial movement of the rod 56 provides a "dead stop" which accurately positions the axis 56 for insuring accurate, quick forming of the flange E with a positive 90° turn of the flange.

If the piston 72 does not "bottom out" against the wall E, the rod end yoke 56 and roller 52 will tend to slide or move during the forming operation and the internal corner between the cylinder and the flange will be rounded as opposed to being at right angles in a sharp "corner".

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. Tube flaring apparatus for forming a radially outwardly extending, flange on an end of a hollow malleable cylindrical conduit comprising:

a stationary support member;

a hollow, rotary drive spindle journaled on said stationary support member for rotation about its axis;

workpiece holding means, coupled to one end of said drive spindle for rotation therewith, cantileverly mounting a hollow, malleable conduit workpiece for rotation about said axis;

axially and radially translatable flare forming means, adjacent said one end of said drive spindle moveable between an axially outer, radially inner position, removed from said conduit, and an axially inner, radially outer, conduit flaring position, bearing against a radially inner portion of one end of said malleable conduit to axially and radially displace said one end of said conduit to form said flange;

means mounting said flare forming means for radial movement between said radially inner and outer positions;

means for moving said flare forming means between said axially inner and outer positions including a fluid pressure operated cylinder adjacent an axially opposite end of said hollow rotary drive spindle;

a cooperating fluid pressure operated piston disposed in said cylinder for axial movement therein;

piston rod means, received by said rotary drive spindle, coupling said piston, adjacent said axially opposite end of said spindle, to said flare forming means, adjacent said one end of said spindle, for axially moving said flare forming means from said axially outer position to said axially inner position as said flare forming means moves from said radially inner position to said radially outer position;

spacer means, disposed radially between said piston rod means and said spindle, axially extending between said workpiece holding means at said one end of said drive spindle and said cylinder at said opposite end of said drive spindle to preclude relative axial movement of said cylinder and said workpiece holding means when said flare forming means is moved from said axially outer, radially inner position to said axially inner, radially outer position to axially and radially displace said one end of said conduit to form said flange.

2. The tube flaring apparatus set forth in claim 1 wherein said fluid pressure operated cylinder is pneumatically operated.

3. The tube flaring apparatus set forth in claim 1 wherein said stationary support member comprises a stationary head including a bore therethrough journaling said spindle for rotation therein.

4. The apparatus set forth in claim 3 wherein said workpiece holding means mounts to only an end of said conduit axially opposite said one end such that said one end of said conduit is free for radially outward movement.

5. The apparatus set forth in claim 1 wherein said spacer means comprises a hollow cylindrical stop member fixed at one end to said cylinder, a thrust bearing sandwiched between an opposite end of said hollow cylindrical stop and said workpiece holding means.

6. The apparatus set forth in claim 1 wherein said flare forming means includes an axially inner portion pivotally mounted on said piston rod means for axial movement therewith and an axially outer roll portion which is rotatable relative to said axially inner portion.

7. The apparatus set forth in claim 1 wherein said piston rod means is coaxially disposed with said axis of rotation and said axially outer roll portion is eccentrically mounted on said piston rod means relative to said axis of rotation.

8. Tube flaring apparatus for forming a radially outwardly extending flange on an end of a longitudinally extending, malleable conduit comprising:

a stationary head having an axially extending opening therethrough;

a rotary hollow drive spindle journaled in said opening for rotation about its axis;

a workpiece mounting chuck, coupled to said spindle for rotation therewith, for mounting a hollow malleable conduit;

a tube flaring tool, adjacent one axial end of said drive spindle, moveable between a radially inner position and a radially outer flaring position bearing against a radially inner portion of one end of said malleable tube;

means mounting said flaring tool for axial movement between an axially outer position, when said tool is in said radially inner position, and an axially inner position when said tool is in said radially outer flaring position;

said mounting means including a fluid pressure operated cylinder stationarily mounted adjacent the axially opposite end of said drive spindle and a fluid pressure operated, axially moveable piston disposed in said cylinder, and piston rod means coupled to said piston and swingably coupled to said flaring tool at said one end of said spindle; and means for precluding relative axial movement of said workpiece mounting chuck relative to said cylinder as said tube flaring tool moves from said axially outer position to said axially inner position.

9. The apparatus set forth in claim 8 wherein said means for precluding relative axial movement comprises a stop means extending between said cylinder and said chuck.

10. The apparatus set forth in claim 8 wherein said means for precluding relative axial movement comprises spacer means disposed radially between said piston rod means and said spindle.

11. The apparatus set forth in claim 10 wherein said spacer means axially extends between said workpiece mounting chuck at said one end of said spindle and said pneumatically operated cylinder at said opposite end of said spindle.

12. The apparatus set forth in claim 11 wherein said opening in said stationary head comprises a bore coaxial with said spindle.

13. The apparatus set forth in claim 11 wherein said piston rod is coaxial with spindle.

14. Tube flaring apparatus for forming a radially outwardly extending flange on an end of a malleable conduit comprising:

a stationary head having an axially extending opening therethrough;

a rotary hollow drive spindle journaled in said opening for rotation about its axis;

a workpiece mounting chuck, coupled to said spindle for rotation therewith, for mounting a hollow malleable conduit;

a tube flaring tool, adjacent one axial end of said drive spindle, moveable between a radially inner position and a radially outer flaring position bearing against a radially inner portion of one end of said malleable tube;

means mounting said flaring tool for axial movement between an axially outer position, when said tool is in said radially inner position, and an axially inner position when said tool is in said radially outer flaring position; and said mounting means including a fluid pressure operated cylinder stationarily mounted adjacent the axially opposite end of said drive spindle and a fluid pressure opening, axially moveable piston disposed in said cylinder, and piston rod means coupled to said piston and swingably coupled to said flaring tool at said one end of said spindle;

said piston rod means being moveable in a direction toward said workpiece mounting chuck during an initial portion of movement of said flaring tool from said radially inner position to said radially outer position; and stop means for interrupting movement of said piston rod means in a direction toward said workpiece mounting chuck during a final portion of movement of said flaring tool from said radially inner position to said radially outer position.

15. The apparatus set forth in claim 14 wherein pivot means pivotally mounts said flaring tool on said piston rod means for swinging movement thereon.

16. Tube flaring apparatus for forming a radially outwardly extending, flange, having axially inner and outer end surfaces on an end of a hollow, elongate, malleable cylindrical conduit having a cylindrical wall provided with an axis and having a radially inner wall surface and a radially outer wall surface comprising:

a stationary support member;

a hollow, rotary drive spindle journaled on said stationary support member for rotation about its axis;

workpiece holding means, coupled to one end of said drive spindle for rotation therewith, cantileverly mounting a hollow, malleable conduit workpiece for rotation about said axis;

axially and radially translatable flare forming means, adjacent said one end of said drive spindle moveable between an axially outer, radially inner position, removed from said conduit, and an axially inner, radially outer, conduit flaring position, bearing against a radially inner portion of one end of said malleable conduit to axially and radially displace said one end of said conduit to form said flange;

means mounting said flare forming means for radial movement between said radially inner and outer positions;

means for moving said flare forming means between said axially inner and outer positions including a fluid pressure operated cylinder adjacent an axially opposite end of said hollow rotary drive spindle;

a cooperating fluid pressure operated piston disposed in said cylinder for axial movement therein;

piston rod means, received by said rotary drive spindle, coupling said piston, adjacent said axially opposite end of said spindle, to said flare forming means, adjacent said one end of said spindle, for axially moving said flare forming means from said axially outer position to said axially inner position as said flare forming means moves from said radially inner position to said radially outer position;

means for axially inwardly swingably moving said flare forming means toward said cylinder while concurrently moving said piston rod means a predetermined distance axially outwardly toward said workpiece holding means during an initial portion of movement of said flare forming means from said radially inner position to said radially outer position; and stop means for interrupting continued axial movement of said piston means after said predetermined axial movement while said flare forming means completes its movement to said radially outer position for forming a 90° corner at the junction of said radially inner wall surface and said axially outer end surface.

17. Tube flaring apparatus for forming a radially outwardly extending flange on an end of a malleable conduit comprising:

a stationary head having an axially extending opening therethrough;

a rotary hollow drive spindle journaled in said opening for rotation about its axis;

a workpiece mounting chuck, coupled to said spindle for rotation therewith, for mounting a hollow malleable conduit;

a tube flaring tool, adjacent one axial end of said drive spindle, moveable between a radially inner position and a radially outer flaring position bearing against a radially inner portion of one end of said malleable tube;

means mounting said flaring tool for axial movement between an axially outer position, when said tool is in said radially inner position, and an axially inner position when said tool is in said radially outer flaring position;

means for axially moving said tool between said axially inner and outer portion including a fluid pressure operated cylinder stationarily mounted adjacent the axially opposite end of said drive spindle and a fluid pressure operated axially moveable piston disposed in said cylinder, and piston rod means coupled to said piston and swingably coupled to said flaring tool at said one end of said spindle;

means for axially outwardly moving said piston rod means a predetermined distance toward said chuck, while concurrently swinging said flaring tool in an opposite, axially inward, direction toward said chuck during an initial portion of radial movement of said flaring tool from said radially inner position to said radially outer position; and stop means for interrupting continued axially outward movement of said piston rod means while said flaring tool continues its movement from said radially inner position to said radially outer position to form a flange which is joined to said conduit at a 90° angle.

18. Tube flaring apparatus for forming a radially outwardly extending flange having axially inner and outer end wall surfaces on an end of a hollow, elongate, malleable conduit having a longitudinal axis and a cylindrical wall provided with a radially inner wall surface and a radially outer wall surface comprising:

a stationary head having an axially extending opening therethrough;

a rotary hollow drive spindle journaled in said opening for rotation about its axis;

a workpiece mounting chuck, coupled to said spindle for rotation therewith, for mounting said hollow malleable conduit;

means for forming a flange on one end of said conduit, which is joined to said conduit at a sharp 90° angle between the junction of said radially inner wall surface and said axially outer end wall surface comprising a tube flaring tool, adjacent one axial end of said drive spindle, moveable between a radially inner position and a radially outer flaring position bearing against a radially inner portion of one end of said malleable tube;

means mounting said flaring tool for axial movement between an axially outer position, when said tool is in said radially inner position, and an axially inner position when said tool is in said radially outer flaring position; and means for bodily axially inwardly swingably moving said flaring tool toward said chuck during an initial portion of the radial movement of said flaring tool from said radially inner position; and stop means for positively interrupting continued axial bodily movement of said flaring tool while said flaring tool continues and completes its movement from said radially inner position to said radially outer position.

* * * * *